US008388404B2

(12) United States Patent
Okumura et al.

(10) Patent No.: US 8,388,404 B2
(45) Date of Patent: Mar. 5, 2013

(54) TRANSFORMABLE TOY

(75) Inventors: Shinnosuke Okumura, Tokyo (JP); Noboru Kasahara, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 465 days.

(21) Appl. No.: 12/677,027

(22) PCT Filed: Mar. 17, 2009

(86) PCT No.: PCT/JP2009/055159

§ 371 (c)(1),
(2), (4) Date: Mar. 8, 2010

(87) PCT Pub. No.: WO2009/116526

PCT Pub. Date: Sep. 24, 2009

(65) Prior Publication Data

US 2010/0330871 A1 Dec. 30, 2010

(30) Foreign Application Priority Data

Mar. 18, 2008 (JP) ..... 2008-069985

(51) Int. Cl.
*A63H 3/46* (2006.01)

(52) U.S. Cl. ..... 446/383; 446/376; 446/378

(58) Field of Classification Search ..... 446/276, 446/378, 376, 383

See application file for complete search history.

(56) References Cited

U.S. PATENT DOCUMENTS

| | | | | |
|---|---|---|---|---|
| 4,206,564 | A * | 6/1980 | Ogawa | 446/94 |
| 4,516,948 | A * | 5/1985 | Obara | 446/95 |
| 4,529,391 | A * | 7/1985 | Hoshino et al. | 446/356 |
| 4,580,993 | A * | 4/1986 | Ohno | 446/376 |
| 4,586,911 | A * | 5/1986 | Murakami | 446/376 |
| 4,594,071 | A * | 6/1986 | Zaruba et al. | 446/99 |
| 4,674,990 | A * | 6/1987 | Ohno | 446/376 |
| 5,924,910 | A * | 7/1999 | Liu | 446/470 |
| 5,954,677 | A * | 9/1999 | Albrecht et al. | 602/16 |
| 6,267,640 | B1 * | 7/2001 | Akashi et al. | 446/376 |
| 6,482,068 | B2 * | 11/2002 | Lee et al. | 446/376 |
| 8,011,992 | B2 * | 9/2011 | Ejima | 446/93 |
| 2006/0189251 | A1 | 8/2006 | Okamoto et al. | |
| 2006/0258260 | A1 * | 11/2006 | Okamoto et al. | 446/321 |
| 2008/0233833 | A1 * | 9/2008 | Toriyama et al. | 446/321 |

FOREIGN PATENT DOCUMENTS

| | | |
|---|---|---|
| JP | 2005-034400 | 2/2005 |
| JP | 2006-136660 | 6/2006 |
| JP | 2008-259772 | 10/2008 |

* cited by examiner

*Primary Examiner* — Gene Kim

*Assistant Examiner* — Joseph B Baldori

(74) *Attorney, Agent, or Firm* — Rankin, Hill & Clark LLP

(57) ABSTRACT

A transformable toy, in which exposure of a coupling mechanism is reduced and the turning range of the second exterior member with respect to the first exterior member is increased, is provided. An exterior main body for a shin section covers a part of an intermediate member and has an opening portion at a location opposing a thigh section when the shin section turns toward the thigh section. A movable exterior member, which moves through a link mechanism, is coupled to the intermediate member via the link mechanism, and configured to block the opening portion when it is at a first position and to be at least partially located inside the exterior main body when it is at a second position.

15 Claims, 15 Drawing Sheets

TRANSFORMABLE TOY

TECHNICAL FIELD

The present invention relates to a transformable toy with a transformable shape.

BACKGROUND ART

Japanese Patent Application Publication No. 2004-344190 (JP2004-344190A) and Japanese Patent Application Publication No. 2004-344191 (JP2004-344191A) disclose a transformable toy having a first exterior member forming a thigh section, a second exterior member forming a shin section, and a coupling mechanism that couples the first exterior member and the second exterior member. The coupling mechanism includes an intermediate member coupled to the first exterior member by a first turning pair and coupled to the second exterior member by a second turning pair. Thus, the turning range of the second exterior member with respect to the first exterior member can be increased.

SUMMARY OF INVENTION

Technical Problem

In order to increase the turning range of the second exterior member with respect to the first exterior member during transformation of the transformable toy, it is necessary to minimize interference between the first exterior member and the second exterior member. For that purpose, conventionally, a member forming the coupling mechanism is exposed to a degree. If the member forming the coupling mechanism is exposed to a great degree, however, the appearance of the transformable toy may be significantly deteriorated.

An object of the present invention is to provide a transformable toy in which exposure of a coupling mechanism is reduced and the turning range of the second exterior member with respect to the first exterior member is increased.

Solution to Problem

A transformable toy to be improved by the present invention includes a first exterior member, a second exterior member, and a coupling mechanism that couples the first exterior member and the second exterior member. The term "exterior member" as used herein refers to a member forming the outer shape of the transformable toy and coupled to another member via a coupling mechanism. The coupling mechanism includes an intermediate member coupled to the first exterior member by a first turning pair and coupled to the second exterior member by a second turning pair. "Coupling (two link members) by a turning pair" means coupling the two link members so as to be turnable about the center line of the turning pair. Members forming the second turning pair and a part of the intermediate member are disposed inside the second exterior member.

The second exterior member used in the present invention includes an exterior main body and a movable exterior member assembled with the exterior main body. The exterior main body covers a part of the intermediate member, and has an opening portion at a location opposing the first exterior member when the second exterior member turns about a turning center of the second turning pair to approach the first exterior member. The opening portion is opened in a first direction toward the first exterior member, a second direction toward the intermediate member, and a third direction opposite the second direction. The movable exterior member is coupled to the intermediate member via a link mechanism, and configured to block the opening portion when it is at a first position and to be at least partially located inside the exterior main body when it is at a second position. The link mechanism is configured to allow the movable exterior member to move between the first position and the second position with an outer surface of the movable exterior member kept facing (opposing) the opening portion as the second exterior member is turned about the turning center of the second turning pair.

According to the present invention, the exterior main body and the movable exterior member cover a part of the intermediate member when the movable exterior member is at the first position. Then, in a process in which the second exterior member is turned about the turning center of the second turning pair to cause the second exterior member to approach the first exterior member, the movable exterior member gradually retracts inside the exterior main body with the movable exterior member facing the opening portion. It is thus possible to prevent exposure of the coupling mechanism during the turning process of the second exterior member. With the movable exterior member at least partially retractable inside the exterior main body, it is also possible to prevent interference between the movable exterior member, which forms a part of the second exterior member, and the first exterior member, increasing the turning range of the second exterior member with respect to the first exterior member.

Preferably, the second position of the movable exterior member is defined such that the movable exterior member does not interfere with the first exterior member when it is at the second position. With this configuration, the first exterior member and the second exterior member do not interfere with each other, preventing damage to the outer surfaces of both the exterior members due to interference therebetween.

The link mechanism may include a first movable link coupled to the intermediate member by a third turning pair with a part of the intermediate member working as a stationary link, a second movable link coupled to the first movable link by a fourth turning pair and formed by a part of the movable exterior member, and a third movable link coupled to the second movable link by a sliding pair and formed by a part of the exterior main body. This configuration allows the movable exterior member to reliably move between the first position and the second position along with the movement of the link mechanism.

If the link mechanism is used, preferably, the fourth turning pair is configured to turn within a limited turning range to cause the movable exterior member to move along an inner wall surface of the exterior main body with a gap between the movable exterior member and the inner wall surface as the movable exterior member reciprocally moves between the first position and the second position. With this configuration, it is possible to limit the moving range of the movable exterior member, in a process in which the movable exterior member moves. As a result, it is possible to minimize the possibility of interference between the movable exterior member and other members in the exterior main body.

In order to limit the turning range of the fourth turning pair, the movable exterior member may include a first member forming the second movable link and a second member disposed outside the first member to block the opening portion, for example. The first movable link may have one or more projections at an end thereof. A groove portion may be formed between the first and second members to allow the projections to swing about a turning center of the fourth turning pair within a limited angular range. With this configuration, the movement of the projections is limited inside the groove portion, as a result of which the angular range of the swinging motion is limited.

The sliding pair between the second movable link and the third movable link may include a pair of slide grooves formed in an inner wall portion of the exterior main body, and a pair of sliders provided on the second movable link to slide in the pair of slide grooves. In this configuration, the exterior main body may include a pair of main body half portions assembled together. Preferably, the main body half portions have the pair of slide grooves formed therein. The thus configured sliding pair is easily formed during the assembly of the second exterior member. Also, the pair of sliders are easily positioned in the slide grooves.

Preferably, the slide grooves are shaped to allow the movable exterior member to move along an inner wall surface of the exterior main body such that the outer surface of the movable exterior member does not contact the inner wall surface. With this configuration, the moving range of the movable exterior member can be reliably restricted to cover the intermediate member as much as possible even with some variations in the dimension of components forming the link mechanism.

Preferably, the intermediate member has a cover member mounted thereon, and the cover member covers a portion of the intermediate member that is not covered by either the first exterior member or the second exterior member. The cover member may be provided not to interfere with either the first exterior member or the second exterior member as the movable exterior member moves between the first position and the second position. This configuration further improves the appearance.

If the transformable toy is a doll transformable toy, the first exterior member may be for a thigh section of the transformable toy, and the second exterior member may be for a shin section of the transformable toy. Alternatively, the first exterior member may be for an upper arm section of the transformable toy, and the second exterior member may be for a lower arm section of the transformable toy.

BEST MODE FOR CARRYING OUT THE INVENTION

Figure 1:
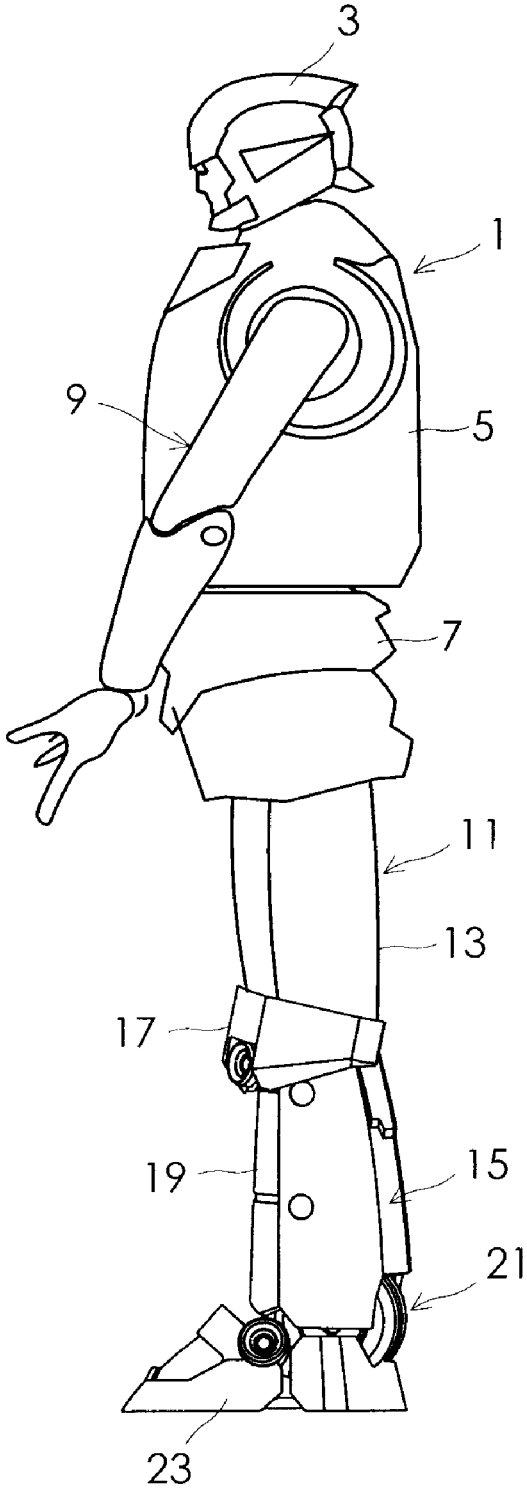
FIG. 1 is a side view of a transformable toy (doll robot toy) according to an embodiment of the present invention in a standing state.

A transformable toy according to an embodiment of the present invention will be described below in detail with reference to the drawings. FIG. 1 is a side view of a transformable toy (doll robot toy) 1 according to the embodiment in a standing state. As shown in FIG. 1, the doll robot toy 1 includes a head section 3, an upper body section 5, a lower body section 7, a pair of arm sections 9, and a pair of leg sections 11. Only the left arm section 9 and the left leg section 11 are shown in FIG. 1. The right leg section 11 is described as a typical example in the description below. The head section 3, the upper body section 5, the lower body section 7, and the pair of arm sections 9 may have a configuration known in the art. Therefore, they are not relevant to the gist of the present invention, and thus will not be described in detail herein. The leg sections 11 each include a thigh section 13 and a crus section 15. The crus section 15 includes a knee section 17, a shin section 19, an ankle section 21, and a foot section 23. In the embodiment, the thigh section 13 is equivalent to a first exterior member of the transformable toy according to the present invention, and the shin section 19 is equivalent to a second exterior member of the transformable toy according to the present invention. Although not shown in FIG. 1, a coupling mechanism 20 to be discussed later is provided between the thigh section 13 and the shin section 19 to allow turning motion therebetween.

Figure 2A:
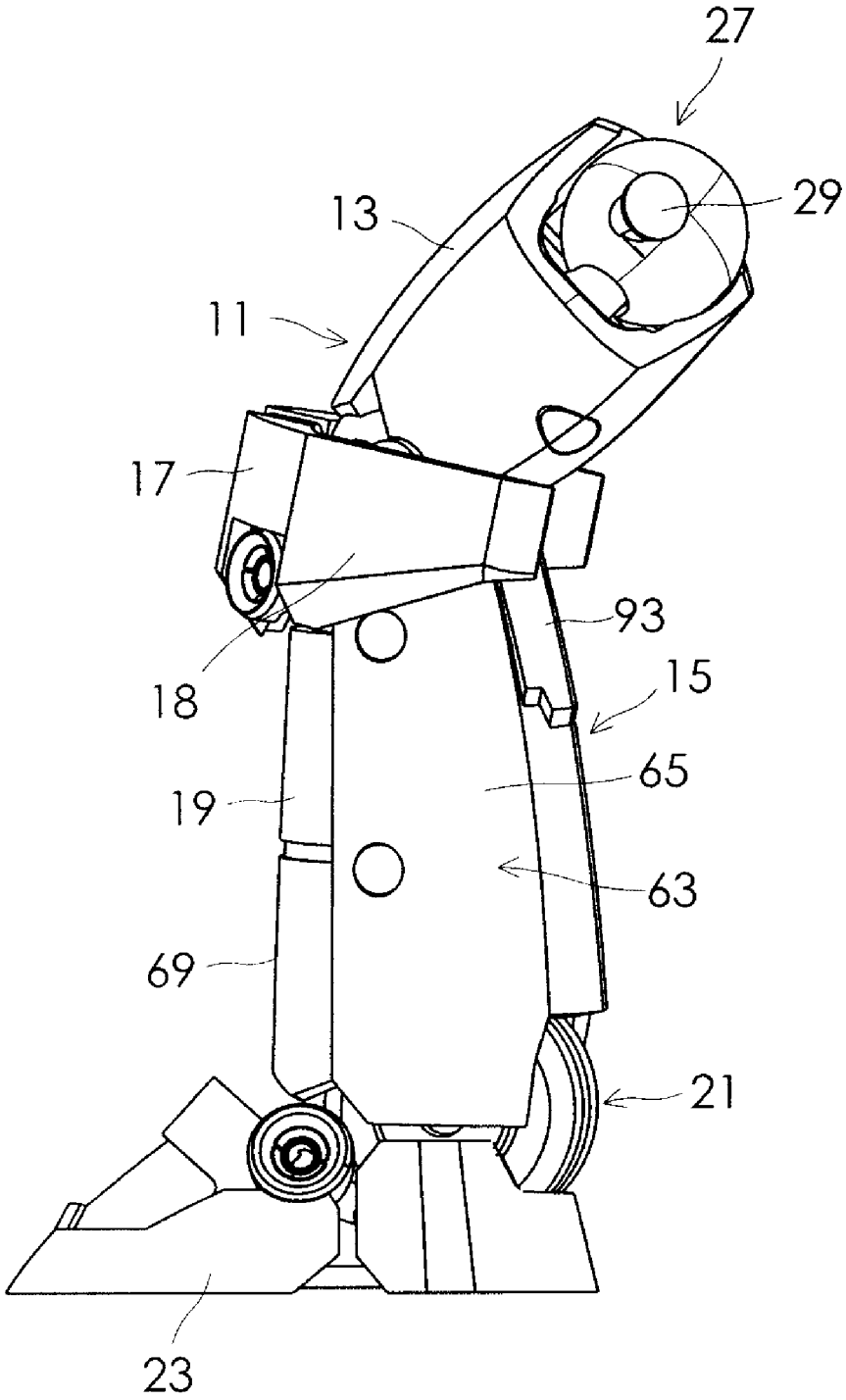
FIGS. 2(A) and 2(B) are a right side view and a front view, respectively, of a leg section of the doll robot toy of FIG. 1.
Figure 2B:
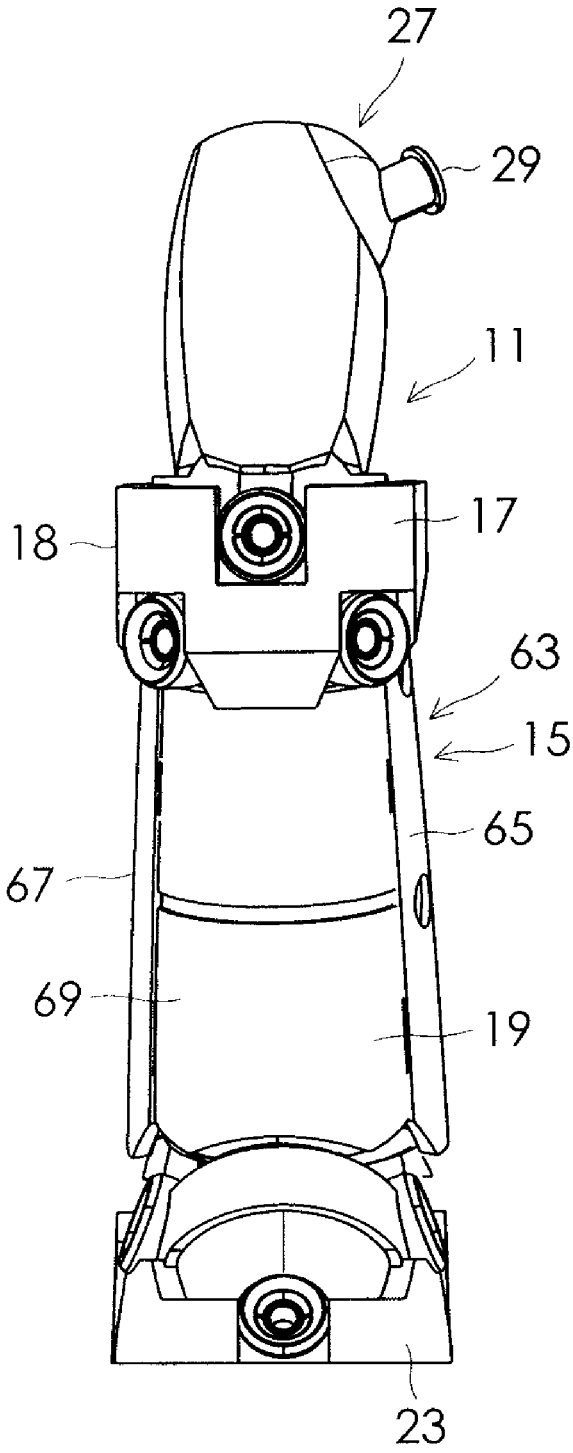
Figure 3:
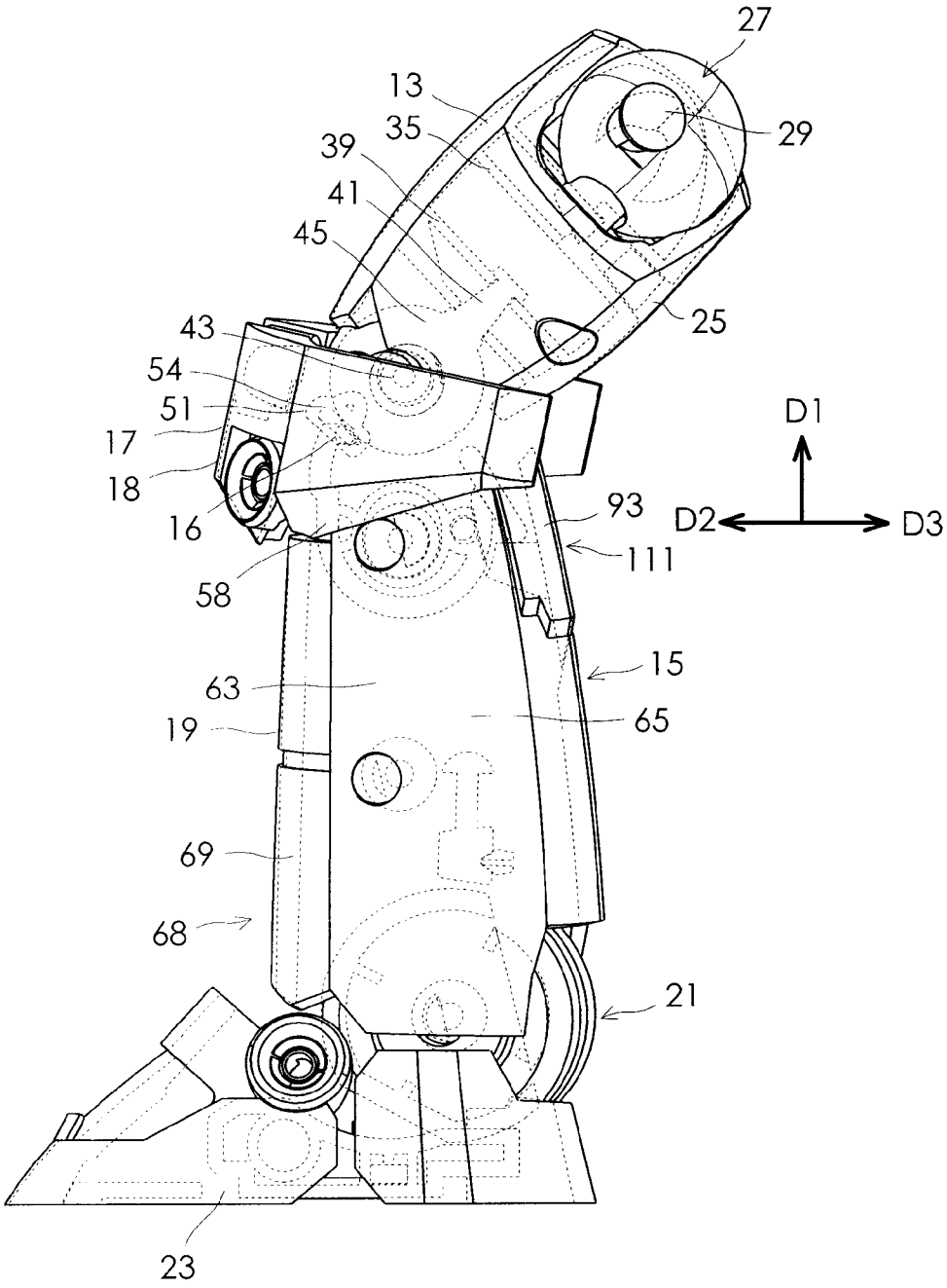
FIG. 3 is an enlarged view of FIG. 2A showing members disposed inside the leg section by virtual lines.
Figure 4:
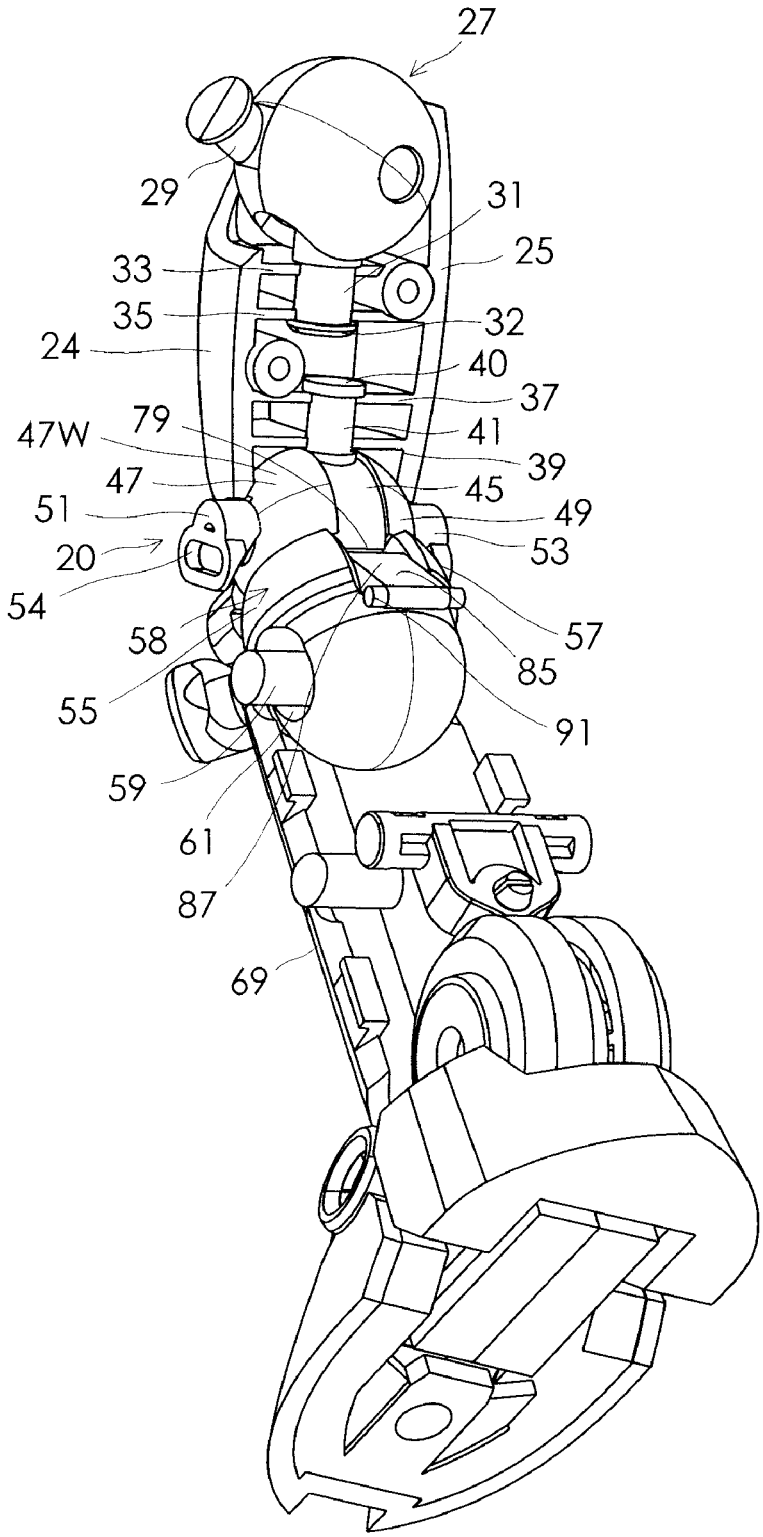
FIG. 4 is a perspective view showing as enlarged the internal structure of the leg section of FIG. 2 with a part of external members removed.
Figure 5:
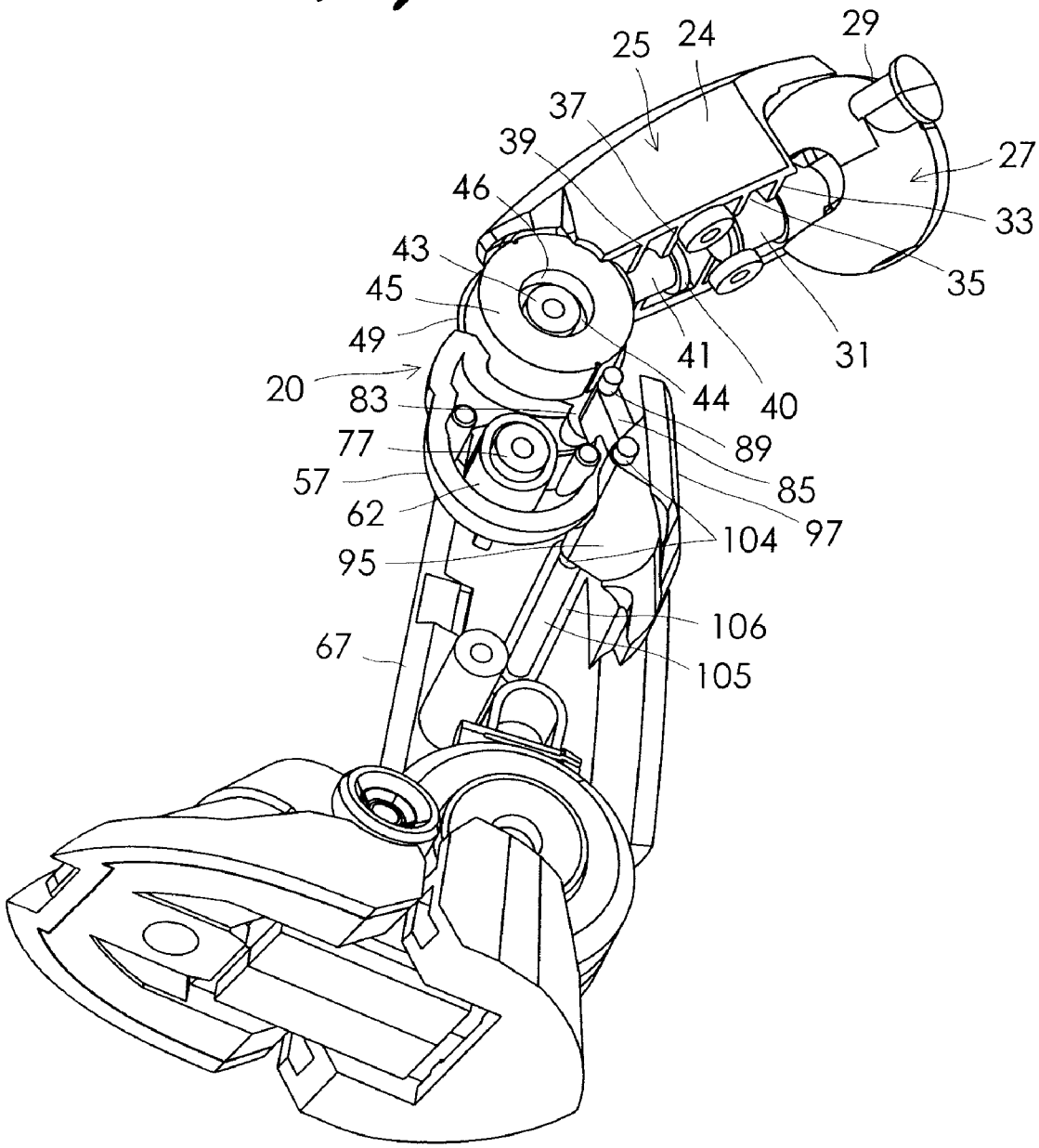
FIG. 5 shows the internal structure shown in FIG. 4 with a part of components further removed.
Figure 6:
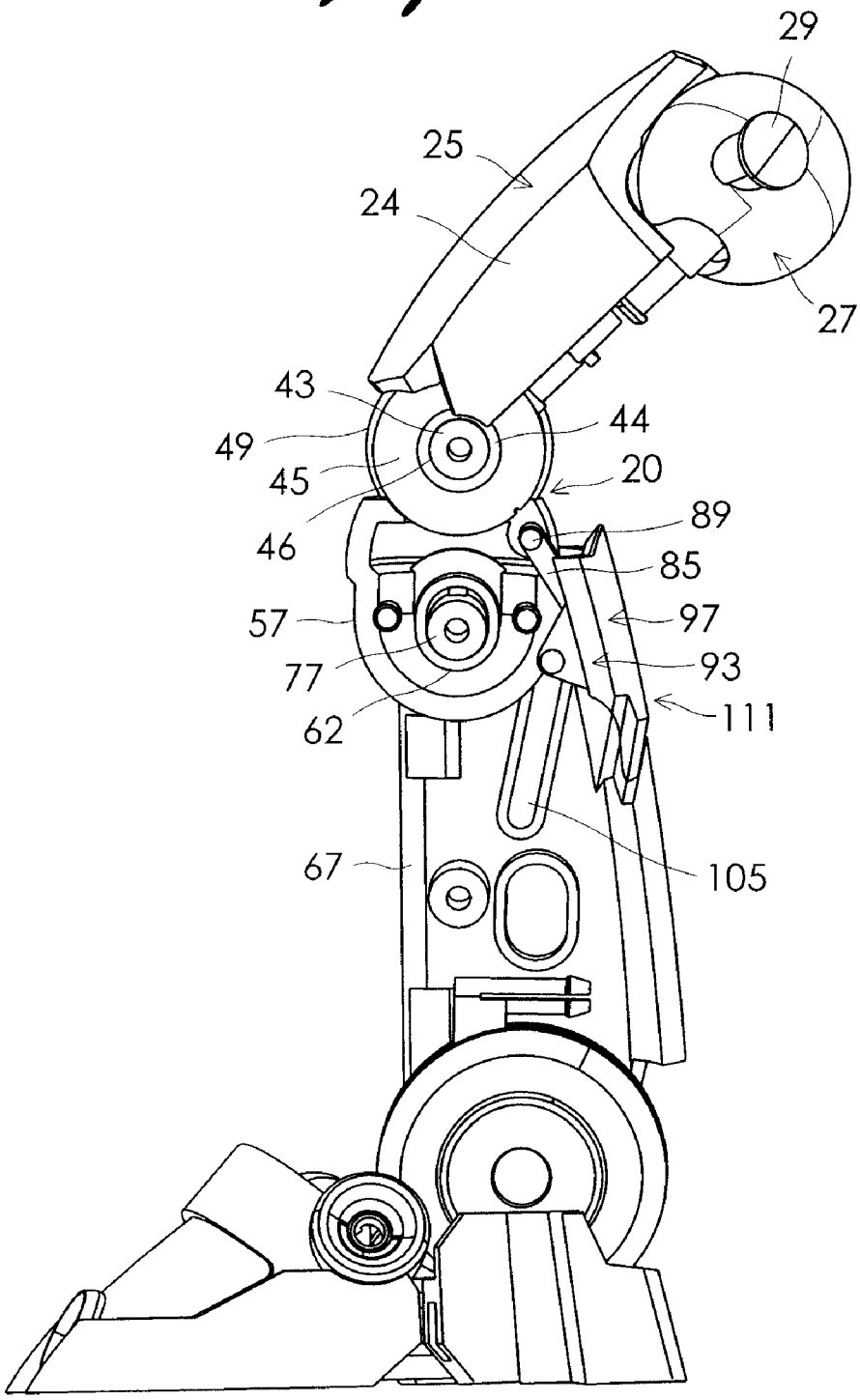
FIG. 6 shows the internal structure shown in FIG. 4 with a part of components further removed.
Figure 7A:
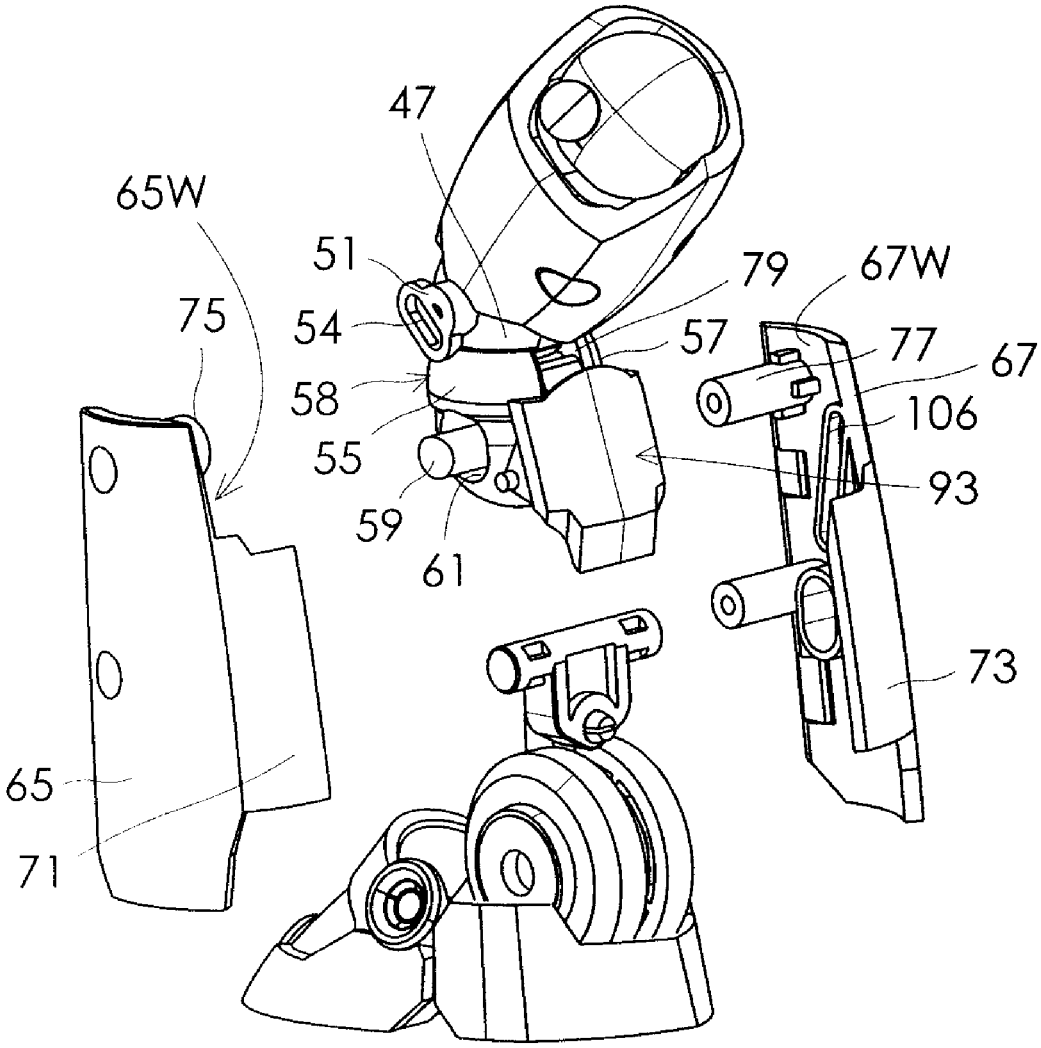
FIG. 7(A) is an exploded perspective view of a crus section of the leg section of FIG. 2.
Figure 7B:
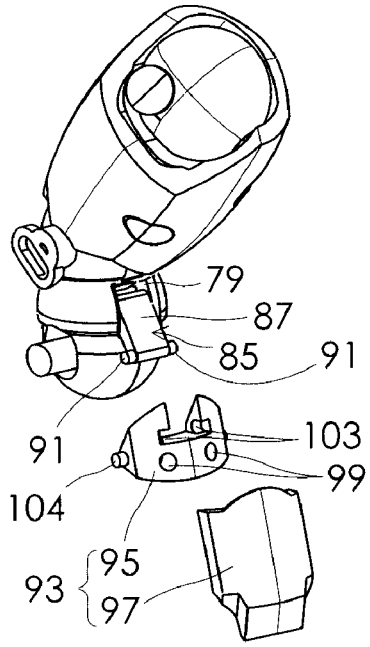
FIG. 7(B) is an exploded perspective view of a member shown in FIG. 7(A)
Figure 8A:
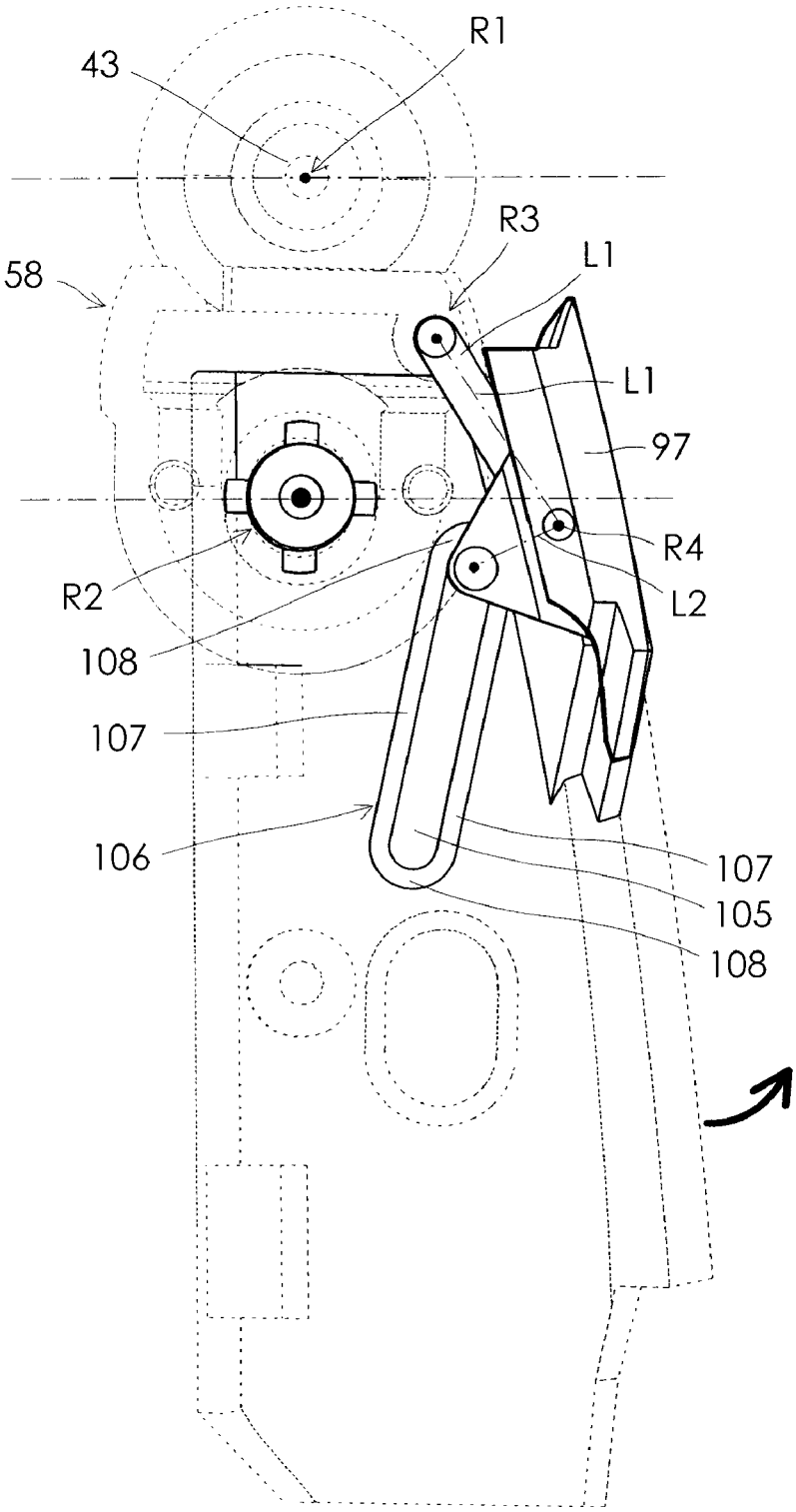
FIGS. 8(A) and 8(B) illustrate a link mechanism disposed inside a shin section of the leg section of FIG. 2.
Figure 8B:
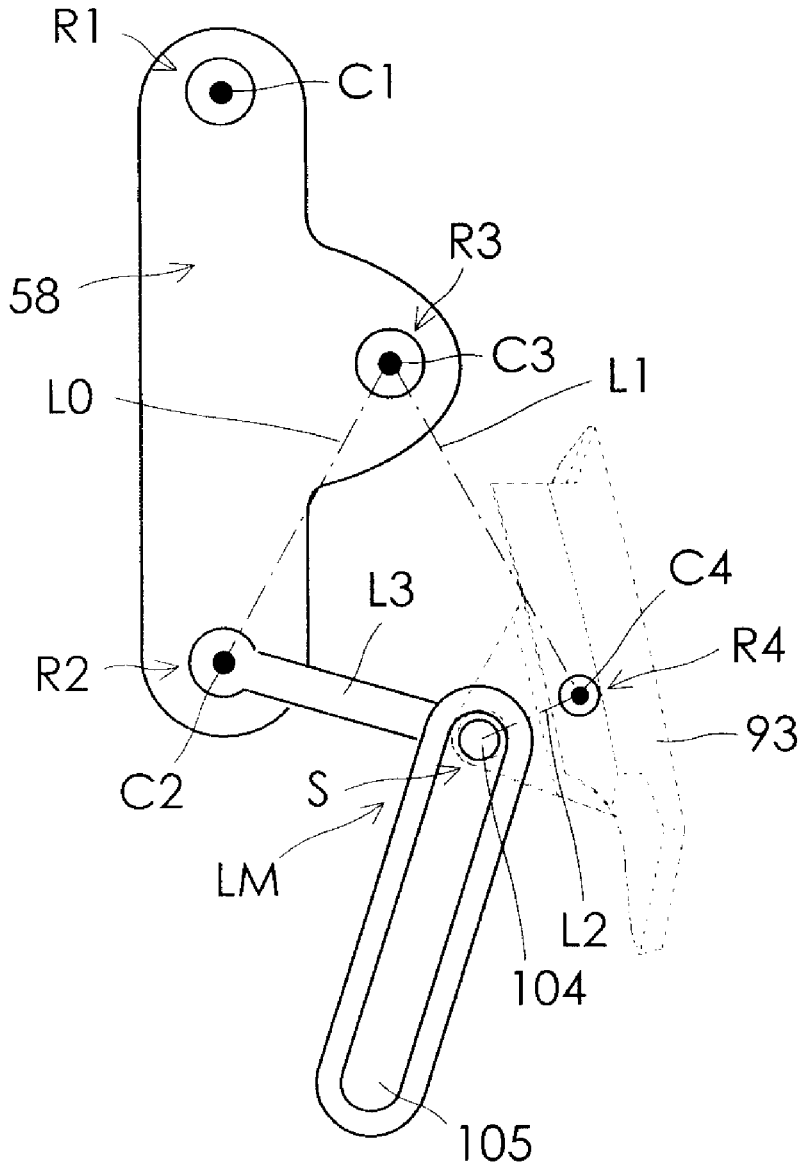

FIGS. 2(A) and 2(B) are a right side view and a front view, respectively, of the leg section 11. FIG. 3 is a right side view of the leg section 11 showing members disposed therein by virtual lines. FIG. 4 shows the internal structure of the leg section 11 with a part of external members removed. FIGS. 5 and 6 show the internal structure shown in FIG. 4 with a part of components further removed. FIG. 7(A) is an exploded perspective view of the crus section 15. FIG. 7(B) is an exploded perspective view of a member shown in FIG. 7(A). FIGS. 8(A) and 8(B) illustrate a link mechanism LM disposed inside the shin section 19.

As shown in FIGS. 2 to 6, the thigh section 13 (first exterior member) includes a joint structure 27 disposed in the upper end portion of an exterior main body 25, which is made up of two exterior half portions 24. The joint structure 27 includes a shaft portion 29 turnably coupled to the lower body section 7 by a turning pair (not shown) and a shaft portion 31 turnably coupled to the exterior main body 25 by a turning pair. As shown in FIGS. 4 and 5, a pair of wall portions 33 and 35 are provided in the upper end portion of the exterior main body 25, and disposed at an interval in the longitudinal direction of the exterior main body 25. The shaft portion 31 is turnably supported by the pair of wall portions 33 and 35 with a flange portion 32 provided at the end of the shaft portion 31 and serving as a retainer. A pair of wall portions 37 and 39 are provided in the lower end portion of the exterior main body 25, and disposed at an interval in the longitudinal direction of the exterior main body 25. A shaft portion 41 having a flange portion 40 at its end is supported by the pair of wall portions 37 and 39 for free turning motion. The shaft portion 41 is integrally formed with the outer peripheral portion of an annular member 45 having a rotary shaft 43 in its center. The annular member 45 and the rotary shaft 43 are coupled by an annular coupling portion 44 with a small thickness. As shown in FIGS. 5 and 6, a pair of annular spaces 46 are formed between the annular member 45 and the rotary shaft 43 on both sides (in the axial direction of the rotary shaft 43) of the annular coupling portion 44.

A pair of holding portions 47 and 49 are disposed on both sides of the annular member 45. A pair of cylindrical bodies (not shown) are integrally formed with portions of the pair of holding portions 47 and 49 opposing the annular member 45, and are fitted into the pair of annular spaces 46 to turn around the rotary shaft 43. The pair of holding portions 47 and 49 turn about the rotary shaft 43 within a predetermined turning range with the pair of cylindrical bodies turning around the rotary shaft 43. In the embodiment, the thigh section 13 corresponds to a first exterior member, and the fitting structure between the pair of cylindrical bodies (not shown) formed on the pair of holding portions 47 and 49 and the rotary shaft 43 corresponds to a first turning pair R1 (FIG. 8) rotatable about the rotary shaft 43 as a turning center C1. As shown in FIG. 4, a pair of attachments 51 and 53 are mounted on outer wall portions 47W and 49W of the pair of holding portions 47 and 49, respectively. An elongated groove 54 is formed in each of the attachments 51 and 53. The pair of grooves 54 formed in the attachments 51 and 53 extend in parallel with each other with an intermediate member 58 of a coupling mechanism 20 (see FIGS. 3 and 4) interposed therebetween. As indicated by virtual lines in FIG. 3, the pair of grooves 54 receive a pair of projections 16 formed on an inner wall portion of a cover member 18, which serves as an exterior component for the knee section 17, so as to be slidable. As shown in FIG. 3, the grooves 54 extend at an inclination from the patella portion of the knee section 17 toward the crus portion of the shin section 19. In the state shown in FIG. 3, thus, the projections 16 formed on the cover member 18 are located in lower regions of the inclined grooves 54.

Another pair of holding portions 55 and 57 are disposed below the pair of holding portions 47 and 49. The pair of holding portions 55 and 57 are assembled to and integrally formed with the pair of holding portions 47 and 49. In the embodiment, the pair of holding portions 47 and 49 and the pair of holding portions 55 and 57 are integrally formed with and assembled to each other to form the intermediate member 58 of the coupling mechanism 20. A columnar portion 59 is integrally formed with one of the holding portions, 55. An annular groove portion 61 is formed between the holding portion 55 and the base portion of the columnar portion 59. A cylindrical body 62 is integrally formed with the other holding portion 57 at a location opposing the columnar portion 59 and the annular groove portion 61, and extends inwardly of the holding portion 57.

An exterior main body 63 for the shin section 19 (second exterior member) includes a pair of sidewall half portions 65 and 67 and a front wall portion 69. As shown in FIG. 7, the pair of sidewall half portions 65 and 67 respectively includes rear wall portion half portions 71 and 73 integrally formed therewith to form a rear wall portion of the exterior main body 63. A front opening portion 68 is formed with the pair of sidewall half portions 65 and 67 assembled to each other. The front wall portion 69 is fixed via an engagement structure to cover the front opening portion 68. In the embodiment, the pair of sidewall half portions 65 and 67 form a pair of main body half portions of the transformable toy according to the present invention. A pair of cylindrical bodies 75 and 77 are integrally formed with inner wall portions 65W and 67W of the pair of sidewall half portions 65 and 67, respectively. One of the cylindrical bodies, 75, is fitted into the annular groove portion 61 formed in the holding portion 55. The end of the columnar portion 59 is loosely fitted into the cylindrical body 75. The other cylindrical body 77 is inserted into the cylindrical body 62 formed in the holding portion 57. In the embodiment, the combination of the cylindrical body 77 formed on the sidewall half portion 67, the cylindrical body 62 formed in the holding portion 57, the columnar portion 59 formed on the holding portion 55, and the cylindrical body 75 formed on the sidewall half portion 65 forms a rotary shaft for a second turning pair R2. The exterior main body 63 for the shin section 19 is coupled by the second turning pair R2 (FIG. 8) turnable about the axis of the rotary shaft (turning center C2 to be discussed later) to turn with respect to the intermediate member 58 (FIGS. 4 and 8) of the coupling mechanism 20 within a predetermined turning range.

A recessed portion 79 (FIGS. 4 and 7) is formed in the pair of holding portions 55 and 57 when they are assembled to each other. The recessed portion 79 is opened toward the pair of holding portions 47 and 49, and opened in the inner direction and the outer direction. The recessed portion 79 is formed between a pair of inner wall portions 81 and 83 of the pair of holding portion 55 and 5Y. One end of a crank member 85, which forms a first movable link L1, is turnably coupled to the pair of inner wall portions 81 and 83 by a third turning pair R3 (FIG. 8). The crank member 85 includes a plate-like member 87, a pair of shaft portions 89 integrally formed on the one end side of the plate-like member 87 on both lateral sides, and a pair of shaft portions 91 integrally formed on the other end side of the plate-like member 87 on both lateral sides. A pair of hole portions (not shown) are formed in the pair of inner wall portions 81 and 83 of the pair of holding portions 55 and 57. The pair of hole portions and the pair of shaft portions 89 are fitted to each other to form a third turning pair R3.

Figure 7C:
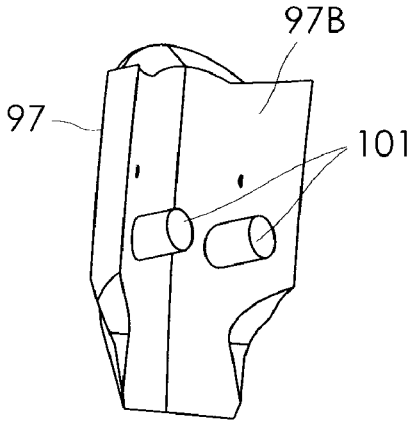
FIG. 7(C) is a perspective view of a member shown in FIG. 7(B).

The crank member 85 is coupled to a movable exterior member 93, which forms a second movable link L2, by a fourth turning pair R4. As shown in FIG. 7(B), the movable exterior member 93 includes a core member (first member) 95 and an outer wall forming member (second member) 97 disposed on the outer side of the core member 95. The movable exterior member 93 is formed by tightly fitting a pair of projections 101, which are formed on a back surface portion 97B of the outer wall forming member 97 as shown in FIG. 7(C), into a pair of hole portions 99 formed in the core member 95. The core member 95 has a pair of shaft receiving holes 103 for turnably receiving the pair of shaft portions 91 formed on the other end side of the crank member 85 on both lateral sides. The pair of shaft portions 91 formed on the crank member 85 are first fitted into the pair of shaft receiving holes 103 formed in the core member 95, and the pair of projections 101 formed on the back surface portion 97B of the outer wall forming member 97 are then fitted into the pair of hole portions 99 formed in the core member 95, preventing the pair of shaft portions 91 from slipping out of the pair of shaft receiving holes 103. The pair of shaft portions 91 and the pair of shaft receiving holes 103 form a fourth turning pair R4. With the presence of the fourth turning pair R4, the movable exterior member 93 is configured to turn about the pair of shaft portions 91 (turning center C4 to be discussed later).

The core member 95 is integrally formed with a pair of columnar sliders 104 extending in the same direction as the pair of shaft portions 91. An upright wall portion 106 is integrally formed on each of the inner wall portions 65W and 67W of the pair of sidewall half portions 65 and 67, respectively, which form a part of the exterior main body 63 for the shin section 19 as discussed above. The upright wall portion 106 has the shape of a closed loop inside which a slide groove 105 is formed. As shown in FIG. 8(A), the upright wall portion 106 includes a pair of straight wall portions 107 extending in parallel with each other and a pair of semi-arcuate wall portions 108 coupling both ends of the wall portions 107. The pair of sliders 104 formed on the core member 95 are slidably fitted into the pair of slide grooves 105 formed at the inner wall portions 65W and 67W of the pair of sidewall half portions 65 and 67, respectively. The upright wall portions 106 are integrally formed on the pair of sidewall half portions 65 and 67 as described above. When they are viewed as a link mechanism, however, it is possible to consider that a part of the pair of sidewall half portions 65 and 67 forms a third movable link L3 as shown in FIG. 8(B). The turning center of the third movable link L3 corresponds to the turning center C2 of the second turning pair R2. In the embodiment, the pair of sliders 104 and the pair of slide grooves 105 form a sliding pair S. When they are viewed as a link mechanism, a portion of the intermediate member 58 that is located between the turning center C2 of the second turning pair R2 and the turning center C3 of the third turning pair R3 forms a stationary link L0.

In the link mechanism LM shown in FIG. 8, when the third movable link L3 turns counterclockwise about the turning center C2 of the second turning pair R2, the slider 104 slides downward in the slide groove 105 as shown in FIG. 8(B). When the slider 104 moves downward in the slide groove 105, the first movable link L1 turns clockwise about the turning center C3 of the third turning pair R3 with the angle between the second movable link L2 and the first movable link L1 widened. The movable exterior member 93 moves along with the movement of the second movable link L2.

As shown in FIG. 3, the exterior main body 63 for the shin section 19 covers a part of the intermediate member 58 of the coupling mechanism 20, and has an opening portion 111 opened in a first direction D1 toward the thigh section 13, a second direction D2 toward the intermediate member 58, and a third direction D3 opposite the second direction D2 at a location opposing the thigh section 13 when the shin section 19 turns about the turning center C2 of the second turning pair R2 to approach the thigh section 13.

FIGS. 9(A) to 9(D) sequentially illustrate a process in which the movable exterior member 93 moves through the action of the link mechanism LM shown in FIG. 8. FIGS. 10(A) and 10(B) are each a perspective view, as viewed from different angles, showing the positional relationship between the movable exterior member 93 and the exterior main body 63 during the process in which the movable exterior member 93 moves through the action of the link mechanism LM shown in FIG. 8. The movable exterior member 93 is coupled to the intermediate member 58 via the link mechanism LM. The movable exterior member 93 is configured to block the opening portion 111 formed in the exterior main body 63 when it is at a first position (the position shown in FIGS. 3, 6, and 9(A)). The movable exterior member 93 is also configured to be at least partially located inside the exterior main body 63 when it is at a second position (the position shown in FIG. 9(D)). Accordingly, the link mechanism LM discussed above is configured to allow the movable exterior member 93 to move between the first position and the second position with an outer surface 93S of the movable exterior member 93 kept facing the opening portion 111 as the exterior main body 63 for the shin section 13 is turned about the turning center C2 of the second turning pair R2. In other words, the movable exterior member 93 is moved with the outer surface 93S located as close to the opening portion 111 as possible in a process in which the movable exterior member 93 moves between the first position and the second position (between the position shown in FIG. 9(A) and the position shown in FIG. 9(D)), preventing the coupling mechanism 20 located inside the exterior main body 63 from being seen from the outside through the opening portion 111.

Figure 9A:
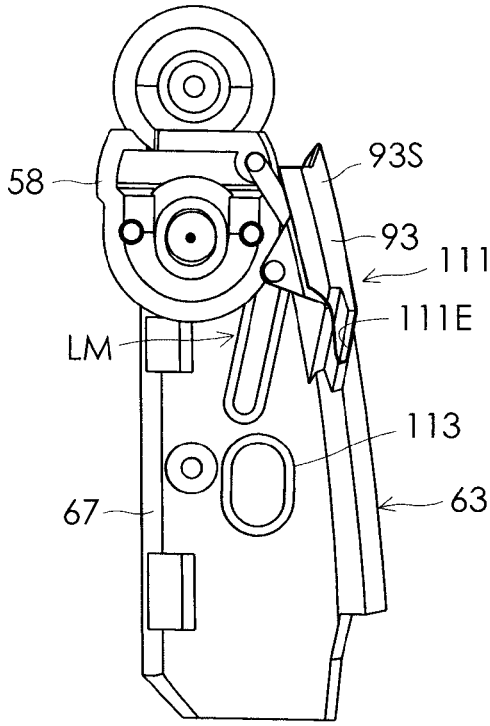
FIGS. 9(A) to 9(D) sequentially illustrate a process in which a movable exterior member moves through the action of the link mechanism shown in FIG. 8.
Figure 9B:
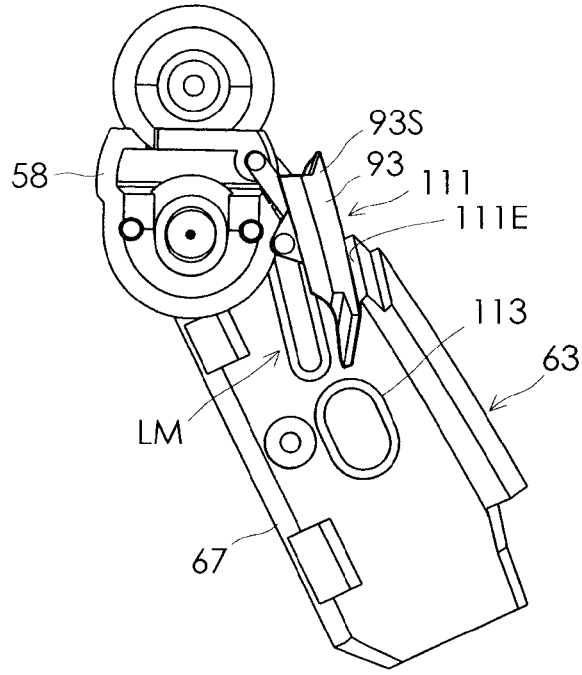
Figure 9C:
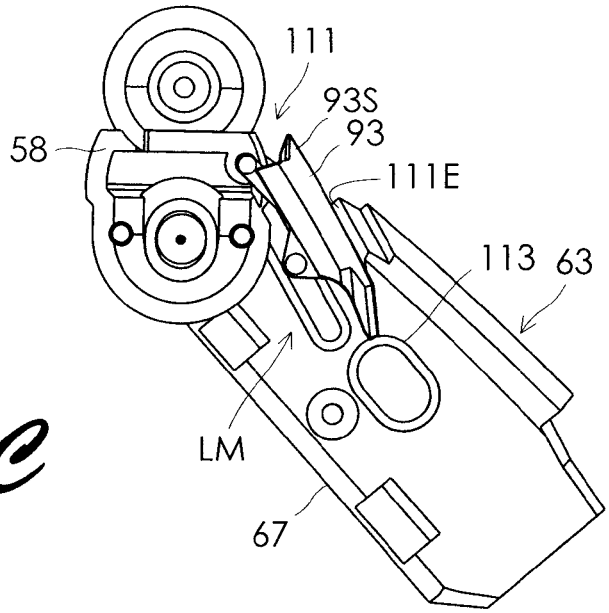
Figure 9D:
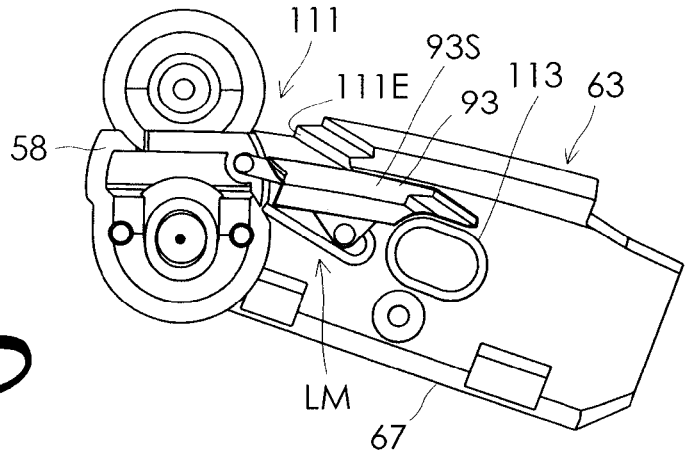
Figure 10A:
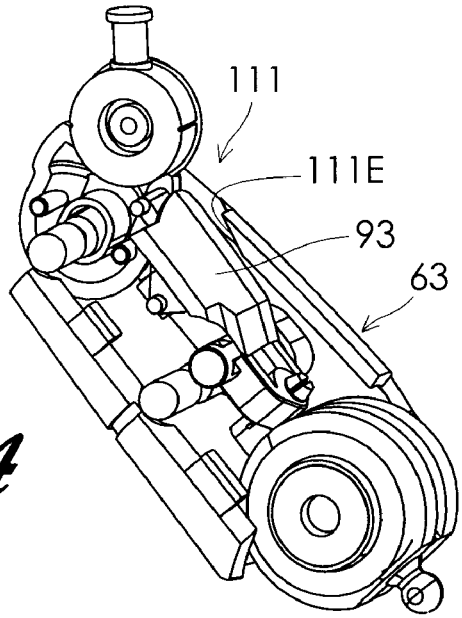
FIGS. 10(A) and 10(B) are each a perspective view, as viewed from different angles, showing the positional relationship between the movable exterior member and an exterior main body during the process in which the movable exterior member moves through the action of the link mechanism shown in FIG. 8.
Figure 10B:
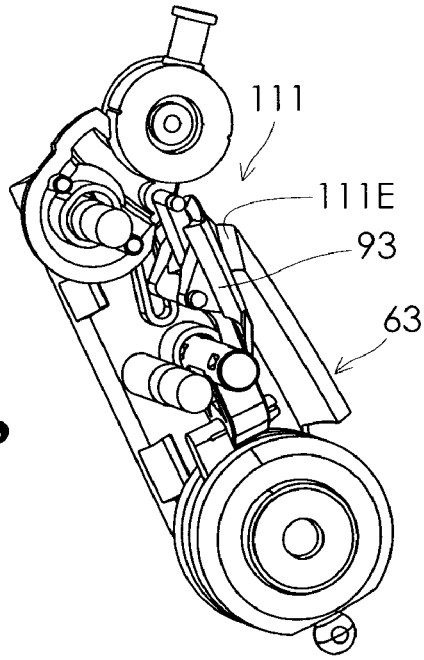

Thus, the exterior main body 63 and the movable exterior member 93 cover a part of the intermediate member 58 when the movable exterior member 93 is at the first position (the position shown in FIG. 9(A)). Then, in a process in which the shin section 19 is turned counterclockwise in FIG. 9 about the turning center C2 of the second turning pair R2 to cause the shin section 19 to approach the thigh section 13, the movable exterior member 93 gradually retracts inside the exterior main body 63 with the movable exterior member 93 facing the opening portion 111. It is thus possible to prevent exposure of the coupling mechanism 20 during the turning process of the shin section 19. With the movable exterior member 93 at least partially retractable inside the exterior main body 63, it is also possible to prevent interference between the movable exterior member 93, which forms a part of the exterior main body 63, and the thigh section 13, increasing the turning range of the shin section 19 with respect to the thigh section 13.

Preferably, the second position of the movable exterior member 93 is defined such that the movable exterior member 93 does not interfere with the thigh section 13 when it is at the second position. With this configuration, the thigh section 13 and the shin section 19 do not interfere with each other at all, preventing damage to the outer surfaces of both the sections due to interference therebetween.

Preferably, the link mechanism LM is configured to turn within a limited turning range of the forth turning pair R4 to cause the movable exterior member 93 to move along an inner wall surface of the exterior main body 63 with a gap between the movable exterior member 93 and the inner wall surface as the movable exterior member 93 reciprocally moves between the first position and the second position. If the turning range of the fourth turning pair R4 (the range of the rotational angle over which the movable exterior member 93 turns clockwise about the turning center C4) is great as seen in FIG. 9, the movable exterior member 93 may rotate so much in a process in which the movable exterior member 93 moves from the first position to the second position that the end of the movable exterior member 93 may come to the left side (as seen in FIG. 9) of an oval guide wall portion 113 shown in FIG. 9(B). If this situation occurs, the movable exterior member 93 may not be returned to the first position, or the outer surface 93S of the movable exterior member 93 may contact the inner wall portion 63W of the exterior main body 63 or contact an edge portion 111E of the opening portion 111 to be damaged. With a limited turning range of the fourth turning pair R4, it is possible to limit the moving range of the movable exterior member 93. As a result, it is possible to minimize the possibility of interference between the movable exterior member 93 and other members in the exterior main body 63.

Figure 11:
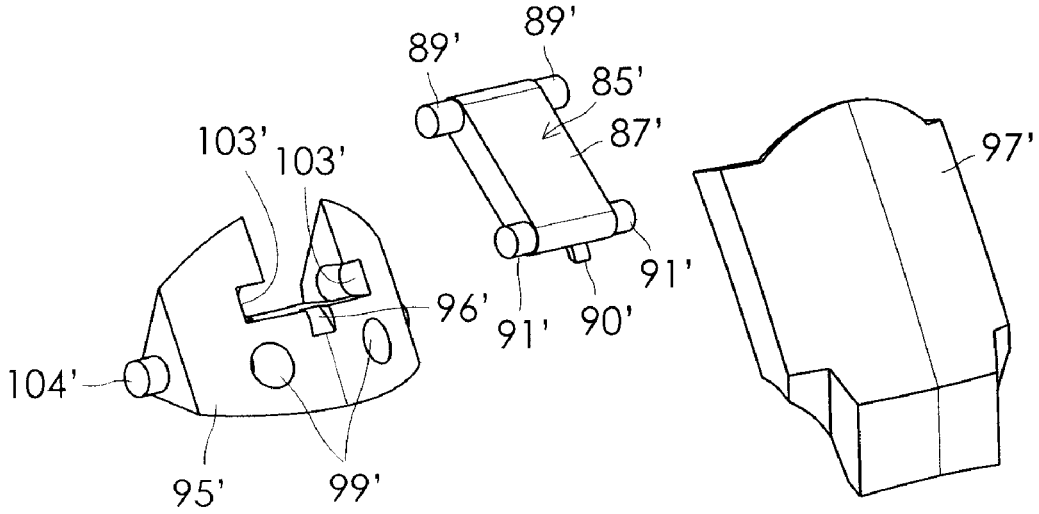
FIG. 11 is an exploded perspective view showing a modification of a crank member and the movable exterior member shown in FIG. 7.

In order to limit the turning range of the fourth turning pair R4, one or more projections 90' are formed at the other end of the plate-like member 87' of the crank member 85' as shown in a modification of FIG. 11, for example. A groove portion 96' for receiving the projections 90' is formed in the core member 95'. The dimensional relationship between the projections 90' and the groove portion 96' is defined to allow the projections 90' to swing about the rotation center of the fourth turning pair R4' within a limited angular range. That is, in the modification of FIG. 11, the projections 90' are only capable of limited swinging motion in the groove portion 96' formed between the core member 95' and the outer wall forming member 97', preventing the movable exterior member 93' from turning about the turning center C4' of the fourth turning pair R4' more than necessary. In the modification of FIG. 11, components common to those in the examples of FIGS. 4 to 8 are denoted by the same reference numerals with an apostrophe (') attached to their ends to omit their descriptions.

Preferably, the slide grooves 105 are shaped to allow the movable exterior member 93 to move along an inner wall surface of the exterior main body 63 such that the outer surface 93S of the movable exterior member 93 does not contact the inner wall surface of the exterior main body 63. With this configuration, the moving range of the movable exterior member 93 can be reliably restricted to cover the intermediate member 58 as much as possible even with some variations in the dimension of components forming the link mechanism.

In the embodiment, the cover member 18 is mounted on the intermediate member 58 to cover the front portion of the intermediate member 58 that is not covered by either the thigh section 13 or the shin section 19 (either the first exterior member or the second exterior member), giving a better appearance. Rather than by providing the cover member 18, however, the front portion of the intermediate member 58 may be covered to a certain degree by elaborately shaping the exterior main body 25 for the thigh section 13 or the exterior main body 63 for the shin section 19. Thus, the cover member 18 may not necessarily be provided.

The structure of the ankle section 23 is not relevant to the present invention, and thus is not described herein.

In the embodiment described above, the first exterior member and the second exterior member are equivalent to the thigh section and the shin section, respectively, of the doll toy. It is a matter of course, however, that the present invention is not limited to the embodiment described above, and may be applied to any section of the doll toy. For example, the first exterior member and the second exterior member may correspond to the upper arm section and the lower arm section, respectively, of the doll toy. Alternatively, the first exterior member and the second exterior member may correspond to the shin section and the thigh section, respectively, of the doll toy.

INDUSTRIAL APPLICABILITY

According to the present invention, it is possible to reduce exposure of the coupling mechanism during the turning process of the second exterior member, and to increase the turning range of the second exterior member with respect to the first exterior member.

The invention claimed is:

1. A transformable toy comprising:

a first exterior member for a thigh section of the transformable toy;

a second exterior member for a shin section of the transformable toy; and a coupling mechanism that couples the first exterior member and the second exterior member, the coupling mechanism comprising an intermediate member coupled to the first exterior member by a first turning pair and coupled to the second exterior member by a second turning pair, and a member forming the second turning pair and a part of the intermediate member being disposed inside the second exterior member, wherein the second exterior member comprises an exterior main body and a movable exterior member assembled with the exterior main body;

wherein the exterior main body covers a part of the intermediate member and has an opening portion opened in a first direction toward the first exterior member, a second direction toward the intermediate member, and a third direction opposite the second direction at a location opposing the first exterior member when the second exterior member turns about a turning center of the second turning pair to approach the first exterior member;

wherein the movable exterior member is coupled to the intermediate member via a link mechanism, and configured to block the opening portion when it is at a first position and to be at least partially located inside the exterior main body when it is at a second position;

wherein the link mechanism is configured to allow the movable exterior member to move between the first position and the second position with an outer surface of the movable exterior member kept facing the opening portion as the second exterior member is turned about the turning center of the second turning pair;

wherein the second position is defined such that the movable exterior member does not interfere with the first exterior member when it is at the second position;

wherein the link mechanism includes a first movable link coupled to the intermediate member by a third turning pair with a part of the intermediate member working as a stationary link, a second movable link coupled to the first movable link by a fourth turning pair, and a third movable link coupled to the second movable link by a sliding pair and formed by a part of the exterior main body;

wherein the fourth turning pair is configured to turn within a limited turning range to cause the movable exterior member to move along an inner wall surface of the exterior main body with a gap between the movable exterior member and the inner wall surface as the movable exterior member reciprocally moves between the first position and the second position;

wherein the movable exterior member includes a first member forming the second movable link and a second member disposed outside the first member to block the opening portion;

wherein the first movable link has one or more projections at an end thereof;

wherein a groove portion is formed between the first and second members to allow the projections to swing about a turning center of the fourth turning pair within a limited angular range, thereby defining the limited turning range of the fourth turning pair;

wherein the sliding pair includes a pair of slide grooves formed in an inner wall portion of the exterior main body, and a pair of sliders provided on the second movable link to slide in the pair of slide grooves;

wherein the exterior main body includes a pair of main body half portions assembled together, the main body half portions having the pair of slide grooves formed therein;

wherein the slide grooves are shaped to allow the movable exterior member to move along the inner wall surface of the exterior main body such that the outer surface of the movable exterior member does not contact the inner wall surface;

wherein the intermediate member has a cover member mounted thereon, the cover member covering a portion of the intermediate member that is not covered by either the first exterior member or the second exterior member so as not to interfere with either the first exterior member or the second exterior member as the movable exterior member moves between the first position and the second position; and wherein the first exterior member is for a thigh section of the transformable toy, and the second exterior member is for a shin section of the transformable toy.

2. A transformable toy comprising:

a first exterior member;

a second exterior member; and a coupling mechanism that couples the first exterior member and the second exterior member, the coupling mechanism comprising an intermediate member coupled to the first exterior member by a first turning pair and coupled to the second exterior member by a second turning pair, and a member forming the second turning pair and a part of the intermediate member being disposed inside the second exterior member, wherein the second exterior member comprises an exterior main body and a movable exterior member assembled with the exterior main body;

wherein the exterior main body covers a part of the intermediate member and has an opening portion opened in a first direction toward the first exterior member, a second direction toward the intermediate member, and a third direction opposite the second direction at a location opposing the first exterior member when the second exterior member turns about a turning center of the second turning pair to approach the first exterior member;

wherein the movable exterior member is coupled to the intermediate member via a link mechanism, and configured to block the opening portion when it is at a first position and to be at least partially located inside the exterior main body when it is at a second position; and wherein the link mechanism is configured to allow the movable exterior member to move between the first position and the second position with an outer surface of the movable exterior member kept facing the opening portion as the second exterior member is turned about the turning center of the second turning pair; and wherein the link mechanism includes a first movable link coupled to the intermediate member by a third turning pair with a part of the intermediate member working as a stationary link, a second movable link coupled to the first movable link by a fourth turning pair, and a third movable link coupled to the second movable link by a sliding pair and formed by a part of the exterior main body; and wherein the movable exterior member includes a first member forming the second movable link and a second member disposed outside the first member to block the opening portion;

wherein the first movable link has one or more projections at an end thereof; and wherein a groove portion is formed between the first and second members to allow the projections to swing about a turning center of the fourth turning pair within a limited angular range, thereby defining the limited turning range of the fourth turning pair.

3. The transformable toy according to claim 2, wherein the second position is defined such that the movable exterior member does not interfere with the first exterior member when it is at the second position.

4. The transformable toy according to claim 3, wherein the first exterior member is for a thigh section of the transformable toy, and the second exterior member is for a shin section of the transformable toy.

5. The transformable toy according to claim 2, wherein the fourth turning pair is configured to turn within a limited turning range to cause the movable exterior member to move along an inner wall surface of the exterior main body with a gap between the movable exterior member and the inner wall surface as the movable exterior member reciprocally moves between the first position and the second position.

6. The transformable toy according to claim 5, wherein the first exterior member is for a thigh section of the transformable toy, and the second exterior member is for a shin section of the transformable toy.

7. The transformable toy according to claim 2, wherein the sliding pair includes a pair of slide grooves formed in an inner wall portion of the exterior main body, and a pair of sliders provided on the second movable link to slide in the pair of slide grooves; and wherein the exterior main body includes a pair of main body half portions assembled together, the main body half portions having the pair of slide grooves formed therein.

8. The transformable toy according to claim 7, wherein the slide grooves are shaped to allow the movable exterior member to move along an inner wall surface of the exterior main body such that the outer surface of the movable exterior member does not contact the inner wall surface.

9. The transformable toy according to claim 8, wherein the first exterior member is for a thigh section of the transformable toy, and the second exterior member is for a shin section of the transformable toy.

10. The transformable toy according to claim 7, wherein the first exterior member is for a thigh section of the transformable toy, and the second exterior member is for a shin section of the transformable toy.

11. The transformable toy according to claim 2, wherein the intermediate member has a cover member mounted thereon, the cover member covering a portion of the intermediate member that is not covered by either the first exterior member or the second exterior member so as not to interfere with either the first exterior member or the second exterior member as the movable exterior member moves between the first position and the second position.

12. The transformable toy according to claim 11, wherein the first exterior member is for a thigh section of the transformable toy, and the second exterior member is for a shin section of the transformable toy.

13. The transformable toy according to claim 2, wherein the first exterior member is for a thigh section of the transformable toy, and the second exterior member is for a shin section of the transformable toy.

14. The transformable toy according to claim 2, wherein the first exterior member is for a thigh section of the transformable toy, and the second exterior member is for a shin section of the transformable toy.

15. The transformable toy according to claim 2, wherein the first exterior member is for a thigh section of the transformable toy, and the second exterior member is for a shin section of the transformable toy.

* * * * *